United States Patent [19]

Burrows et al.

[11] 4,401,581

[45] Aug. 30, 1983

[54] NITROGEN-CONTAINING ASHLESS DISPERSANTS AND LUBRICATING OIL COMPOSITION CONTAINING SAME

[75] Inventors: Aubrey L. Burrows, Bracknell, England; Thomas J. Walter, Baton Rouge, La.

[73] Assignee: Edwin Cooper and Company Limited, Bracknell, England

[21] Appl. No.: 358,344

[22] Filed: Mar. 15, 1982

[30] Foreign Application Priority Data

Apr. 10, 1981 [EP] European Pat. Off. ..... 81301589.8

[51] Int. Cl.[3] ..... C10M 1/32

[52] U.S. Cl. ..... 252/51.5 A

[58] Field of Search ..... 252/51.5 A; 548/545, 548/546

[56] References Cited

U.S. PATENT DOCUMENTS

| | | | |
|---|---|---|---|
| 3,936,480 | 2/1976 | Demoures et al. | 252/51.5 A X |
| 3,948,909 | 4/1976 | Okamoto | 252/51.5 A X |
| 3,950,341 | 4/1976 | Okamoto et al. | 252/51.5 A X |
| 3,991,098 | 11/1976 | Okamoto | 252/51.5 A X |
| 4,049,564 | 9/1977 | Ryer et al. | 252/51.5 A |
| 4,062,786 | 12/1977 | Brois et al. | 252/51.5 A X |
| 4,070,370 | 1/1978 | Elliott et al. | 252/51.5 A X |
| 4,153,566 | 5/1979 | Ryer et al. | 252/51.5 A |
| 4,199,462 | 4/1980 | Solila et al. | 252/51.5 A |
| 4,199,463 | 4/1980 | Ryer et al. | 252/51.5 A |
| 4,253,982 | 3/1981 | Bridger et al. | 252/51.5 A X |

*Primary Examiner*—Andrew Metz

*Attorney, Agent, or Firm*—Donald L. Johnson; John F. Sieberth; Joseph D. Odenweller

[57] ABSTRACT

Lubricating oil dispersants are made by reacting an (a) alkenyl succinic anhydride, (b) an alcohol (e.g. pentaerythritol), (c) a hydroxy-substituted amine (e.g. tris-hydroxymethylaminomethane, (d) a polyoxyalkyleneamine, and (e) an alkenyl succinimide.

13 Claims, No Drawings

NITROGEN-CONTAINING ASHLESS DISPERSANTS AND LUBRICATING OIL COMPOSITION CONTAINING SAME

BACKGROUND

High molecular weight alkenyl succinic derivatives are effective dispersants in lubricating oils. For example, alkenyl succinimides of various amines are described in U.S. Pat. Nos. 3,219,666 and 3,172,892. Alkenyl succinic esters are described in U.S. patent application Ser. Nos. 3,381,022 and 3,331,776. Dispersants containing both ester and amide groups are disclosed in U.S. Pat Nos. 3,184,474 and 3,804,763.

Many of these dispersants provide adequate dispersancy but tend to produce piston lacquer when used in internal combustion engines.

SUMMARY

According to the present invention, ashless dispersants are provided which have reduced piston lacquer deposition characteristics when used in internal combustion engines. These additives are the reaction products of (a) high molecular weight hydrocarbon-substituted succinic acids, anhydrides or esters, (b) alcohols, (c) hydroxy-substituted amines, (d) hydrocarbyl succinimides or succinamides and (e) polyoxyalkylene amines.

DESCRIPTION OF PREFERRED EMBODIMENTS

A preferred embodiment of the invention is a dispersant for use in lubricating oil, said dispersant being the product made by the process comprising reacting (a) about 0.9–1.1 moles of a hydrocarbon-substituted succinic acid or anhydride wherein said hydrocarbon substituent has an average molecular weight of at least about 700, e.g. about 700 to 5000, (b) about 0.1–1.0 moles of an alcohol containing 1–6 hydroxy groups, (c) about 0.01–0.5 moles of a primary or secondary hydroxy-substituted amine containing 1–3 hydroxy groups, (d) about 0.01–2.5 moles of a hydrocarbyl succinimide, or succinamide, and (e) about 0.005–0.5 moles of a polyoxyalkylene amine having the structure $$H_2N—R—(O—R)_m—NH_2 \text{ or } R_1[(O—R)_n—NH_2]_p$$

wherein R is a divalent aliphatic hydrocarbon group containing 2–4 carbon atoms, $R_1$ is a polyvalent saturated hydrocarbon radical having the valence p and containing 2–10 carbon atoms, m is an integer from 1 to 50, n is an integer from 1 to 40 such that the sum of all n's is from about 3 to 40 and p is an integer from 3 to 6, wherein said hydrocarbyl succinimide or succinamide in (d) is the product made by reacting a hydrocarbyl succinic anhydride, acid, or ester with an amine containing 2–6 amino nitrogen atoms, at least one of which is primary, and about 1–30 carbon atoms, at leat part of said hydrocarbyl succinimide or succinamide containing at least one reactive primary or secondary amine group.

When a hydrocarbyl succinic ester is used in (d) the lower esters are preferred such as the methyl, ethyl, isopropyl or isobutyl esters so that the displaced alcohol will distil-off during the reaction.

The hydrocarbon-substituted succinic acids or anhydrides are known compounds. They can be readily made by reacting an olefin of appropriate molecular weight with maleic anhydride at elevated temperatures. If desired, a catalyst such as chlorine (U.S. Pat. No. 3,912,764) or peroxide (S.Af. Patent Specification No. 73-07245) can be included. The product formed is a hydrocarbon-substituted succinic anhydride. If desired, this can be hydrolyzed to the acid or reacted with lower alcohols (e.g. methanol, ethanol, isobutanol, isopropanol, and the like) to provide esters.

The preferred hydrocarbon substituent is a polyolefin substituent such as polypropenyl, polyisobutenyl, and the like. Succinic derivatives having such substituents are made by heating a polyolefin of proper molecular weight with maleic anhydride as described above.

The average molecular weight of the hydrocarbon substituent may suitably be from about 700 to about 30,000. The use of higher molecular weight e.g. 10,000–30,000, for the hydrocarbon substituents does provide VI improving properties. Good detergent properties however can be obtained in the range of 700 to 5000. Most preferably, the hydrocarbon substituent is a polyisobutenyl group having a molecular weight of about 700 to 2000.

A broad range of alcohols can be used such as methanol, isobutanol, dodecanol, eicosanol, triacontanol, hentriacontanol, octatriacontanol, ethylene glycol, diethylene glycol, triethylene glycol, propylene glycol, glycerol, sorbitol, mannitol, sorbitan, mannitan, octadecanol, pentaerythritol, dipentaerythritol, and the like. It can be seen that these include monohydroxy and polyhydroxy alcohols containing up to about six hydroxy groups. The preferred alcohols contain 1 to about 4 hydroxy groups and 1 to about 40 carbon atoms.

The more preferred alcohols are the hindered polyols.

Useful hindered polyols are those which contain about 5–10 carbon atoms and 3–4 hydroxy groups. Representative examples are trimethylolethane, trimethylolpropane, trimethylolbutane, and pentaerythritol. Although not preferred, ethers of these polyols can be used such as dipentaerythritol.

Primary and secondary hydroxy-substituted amines include amines which contain an amino nitrogen atom having at least one reactive hydrogen atom bonded to it. The amines also contain about 1–3 hydroxy substituents and preferably about 2–20 carbon atoms. Examples of such amines are ethanol amine, diethanol amine, propanol amine, N-ethanol dodecylamine, N-ethanol olelamine, N-ethanol ethylenediamine, ethylene oxide treated polyethylene amines such as oxyalkylated diethylene triamine, triethylene tetramine, tetraethylenepentamine, pentaethylene hexamine and the like. The most preferred hydroxy-substituted amines are tris-hydroxymethylaminomethane designated herein as "THAM" and diethanol amine.

Suitable hydrocarbyl succinimides and succinamides used by Step (d) include those in which the hydrocarbyl group contains at least 12 up to about 200 carbon atoms. Examples of such hydrocarbyl groups are dodecyl, dodecenyl, tetradecyl, eicosyl, triacontyl, pentaacontyl, octaacontyl, and still higher alkyl and alkenyl substituents. Processes for making such compounds are well-known; see for instance U.S. Pat. Nos. 3,219,666; 3,172,892; 2,182,178; and 2,490,744. They are made by reacting a hydrocarbyl succinic anhydride, acid or ester with an amine.

Preferably, the hydrocarbyl group is derived from a polyolefin such as polypropylene or polyisobutylene containing 12 to about 200 carbon atoms. The most preferred hydrocarbyls are derived from polyisobutylene containing about 50–200 carbon atoms (mol. wt. about 700–2800).

The imide or amide group of the succinimide or succinamide in Step (d) is derived from primary or secondary amines containing 2–6 amino nitrogen atoms, at least one of which is primary and about 1–30 carbon atoms. Imide formation requires that the amine contain at least one primary amino group. Representative examples of useful amide or imide forming nitrogen compounds are N,N-dimethyl-propanediamine, N-octadecenyl propanediamine, N-(octadecenylamino-propyl)propanediamine, piperazine, piperidine, N-aminoethylpiperazine, N-aminoethylmorpholine, 1,6-hexanediamine, and the like.

Preferably the amide or imide group is derived by reacting a hydrocarbyl succinic acid or anhydride with a polyethylenepolyamine. These amines are sometimes named polyethyleneamines or ethylenepolyamine. These amines for the most part consist of compounds having the formula $$H_2N-(-CH_2CH_2NH-)_q-H$$

wherein q is an integer from 1 to about 10. Such amines are commercial products, representative examples include ethylenediamine, diethylenetriamine, triethylenetetramine, tetraethylenepentamine, and the like, including mixtures thereof. Thus, the hydrocarbyl succinimide is most preferably a polyisobutylene succinimide of a polyethyleneamine in which the polyisobutylene group contains about 50–200 carbon atoms.

The amount of primary or secondary amine used is such that at least a part (e.g. at least 10 mole percent) of the resultant hydrocarbyl succinimide or succinamide contains at least one reactive primary or secondary amine group. Preferably about 10–100 mole percent of the resultant succinimide or succinamide molecules contain a primary amine group. An amount of about 0.5 moles up to about 2.0 moles of amine per mole of hydrocarbyl succinic anhydride, acid or ester can be used.

The polyoxyalkylene amines have the formula (AMSP)

$$H_2N-R-(-O-R-)_m-NH_2$$

$$R_1[(-O-R-)_n-NH_2]_p$$

wherein R, $R_1$, m, n, and p are previously stated. Typical R groups are $$-CH_2CH_2-,\ CH_2-\underset{\underset{CH_3}{|}}{CH}-\ \text{and}\ -CH_2-\underset{\underset{CH_2-CH_3}{|}}{CH}-$$

The compounds can be more specifically represented by the formula (AMSP)

$$H_2N-CH_2\underset{\underset{CH_3}{|}}{CH}-(O-CH_2\underset{\underset{CH_3}{|}}{CH})_m-NH_2$$

or

-continued $$CH_3-CH_2-C\begin{cases}CH_2-(O-CH_2CH_2)_n-NH_2\\CH_2-(O-CH_2CH_2)_n-NH_2\\CH_2-(O-CH_2CH_2)_n-NH_2\end{cases}$$

The above polyoxyethylene amines and polyoxypropylene amines having a molecular weight of about 200–2000 are commercially available from Jefferson Chemical Company under the Trade Name "Jeffamines." Useful "Jeffamines" include those designated D 230, D 400, D 1000, D 2000, T 403, ED 600, ED 900 and ED 2001.

The additives are readily made by reacting (a) 0.9–1.1 moles of the hydrocarbon-substituted succinic acid or anhydride, (b) about 0.1–1.0, more preferably 0.5–1.0 and most preferably 0.7–1.0 moles of the alcohol, (c) about 0.01–0.5, more preferably 0.05–0.2 and most preferably 0.07–0.1 moles of the hydroxy-substituted primary or secondary amine, (d) about 0.01–2.5, more preferably 0.01–0.5 and most preferably 0.1–0.4 moles of the hydrocarbyl succinimide or succinamide, and (e) 0.005–0.5, more preferably 0.000–0.15 and most preferably 0.01–0.1 moles of the polyoxyalkylene amine.

In one embodiment the reactants are all mixed together and heated to reaction temperatures. A useful temperature range is about 100°–350° C., more preferably 175°–300° C. Alternatively, the reactants may be mixed with each other in any combination and prereacted to form intermediate and finally the intermediates mixed and reacted to form the final product.

In a most preferred embodiment, the products are made in a two-storage process by reacting in a first stage (a) about 0.9–1.1 moles of a hydrocarbon-substituted succinic acid or anhydride wherein said hydrocarbon substituent has a molecular weight of at least about 700 e.g. 700–5000, (b) about 0.1–1.0 moles of an alcohol containing 1–6 hydroxy groups, and (c) about 0.01–0.5 moles of a primary or secondary hydroxy-substituted amine containing 1–3 hydroxy groups, to form an intermediate and in a second stage reacting said intermediate with (d) about 0.01–2.5 moles of a hydrocarbyl succinimide or succinamide, and (e) about 0.005–0.5 moles of a polyoxyalkylene amine having a structure $$H_2N-R-(O-R)_m-NH_2 \text{ or } R_1[(O-R)_n-NH_2]_p$$

wherein R is a divalent aliphatic hydrocarbon group containing 2–4 carbon atoms, $R_1$ is a polyvalent saturated hydrocarbon radical having the valence p and containing 2–10 carbon atoms, m is an integer from 1 to 50, n is an integer from 1 to 40 such that the sum of all n's is from about 3 to 40 and p is an integer from 3 to 6, wherein said hydrocarbyl succinimide or succinamide in (d) is the product made by reacting a hydrocarbyl succinic anhydride, acid or ester with an amine containing 2–6 amino nitrogen atoms, at least one of which is primary, and about 1–30 carbon atoms, at least part of said hydrocarbyl succinimide or succinamide containing at least one reactive primary or secondary amine group.

The reaction temperature range in the multi-stage process is about the same as in the single-stage procedure.

The invention includes a method of preparing ashless dispersants comprising reacting (a) about 0.9 to 1.1 moles of a hydrocarbon-substituted succinic acid or anhydride wherein said hydrocarbon substituent has an average molecular weight of at least about 700 e.g. 700 to 5000, (b) about 0.1 to 1.0 moles of an alcohol containing 1-6 hydroxy groups, (c) about 0.01 to 0.5 moles of a primary or secondary hydroxy-substituted amine containing 1 to 3 hydroxy groups, (d) about 0.01 to 2.5 moles of a hydrocarbyl succinimide or succinamide, and (e) about 0.005 to 0.5 moles of a polyoxyalkylene amine having the structure $$H_2N-R-(O-R)_m-NH_2 \text{ or } R_1[(O-R)_n-NH_2]_p$$

wherein R is a divalent aliphatic hydrocarbon group containing 2 to 4 carbon atoms, $R_1$ is a polyvalent saturated hydrocarbon radical having the valence p and containing 2 to 10 carbon atoms, m is an integer from 1 to 50, n is an integer from 1 to 40 such that the sum of all n's is from about 3 to 40 and p is an integer from 3 to 6, wherein said hydrocarbyl succinimide or succinamide in (d) is the product made by reacting a hydrocarbyl succinic anhydride, acid, or ester with an amine containing 2 to 6 amino nitrogen atoms, at least one of which is primary, and about 1 to 30 carbon atoms, at least part of said hydrocarbyl succinimide or succinamide containing at least one reactive primary or secondary amine group.

The invention also provides ashless dispersants which are the product of such a method.

The invention also provides an additive package for use in formulating a lubricating oil containing ashless dispersant of the invention and lubricating oil, and optionally other lubricating oil additives. Typically such an additive package will contain the dispersant and any other additive at a concentration substantially above that required in a lubricating oil composition so that the package may be added to lubricating oil optionally with further additive materials, to form a fully formulated lubricating oil composition.

The following example illustrates the preparation of the dispersants.

EXAMPLE 1

In a reaction vessel under nitrogen was placed 200 grams (0.158 moles) of polyisobutenylsuccinic anhydride, 1.53 grams (0.013 moles) of THAM, 19.8 grams (0.145 moles) of pentaerythritol and 0.22 grams of p-toluene sulfonic acid. The mixture was stirred at 190° C. for three hours. Then 4.42 grams (0.011 moles) of polyoxypropyleneamine (Jeffamine D 400) and 73.7 grams (0.031 moles) of a polyisobutenyl succinimide of a polyethyleneamine mixture having an average analysis of tetraethylene pentamine were added. The reaction was continued at 190° C. for 2.5 hours while water was removed using a nitrogen stream. Then 165.3 grams of process oil was added and the solution cooled to 130° C. A 20 gram portion of filter aid was added and the mixture was filtered. The filtrate was an oil solution of the additive dispersant.

EXAMPLE 2

This procedure was conducted in the same manner as Example 1 except using 5.7 grms (0.003 moles) of polyoxypropylene amine, (Jeffamine D 2000) in place of Jeffamine D 400 and the amount of polyisobutenyl succinimide was adjusted to 97 grams (0.041 moles) and 171.9 grams of process oil was used. The product was an active ashless dispersant.

EXAMPLE 3

This procedure was conducted in the same manner as Example 1 except using 18.7 grams (0.137 moles) of pentaerythritol and 3.0 grams (0.0074 moles) of oxypropylated trimethylolpropane triamine (Jeffamine T 403).

EXAMPLE 4

This procedure was conducted in the same manner as Example 1 except using 1.33 grams (0.012 moles) of diethanolamine in place of THAM. The product was an active ashless dispersant.

EXAMPLE 5

This procedure was conducted in the same manner as Example 1 except using 1.33 grams (0.012 moles) of diethanolamine in place of THAM and 5.7 grams (0.003 moles) of polyoxypropylene amine (Jeffamine D2000) in place of Jeffamine D400 and the amount of polyisobutenyl succinimide was adjusted to 97 grams (0.041 moles) and 171.5 grams of process oil was used. The product was an active ashless dispersant.

EXAMPLE 6

This procedure was conducted in the same manner as Example 1 except using 1.33 grams (0.12 moles) of diethanolamine in place of THAM and 4.8 grams (0.008 moles) of polyoxyalkylene amine (Jeffamine ED600) in place of Jeffamine D400 and the amount of polyisobutenyl succinimide was adjusted to 83.3 grams (0.035 moles) and 168.4 grams of process oil was used. The product was an active ashless dispersant.

EXAMPLE 7

In a reaction vessel was placed 1300 grams (1.03 moles) of polyisobutenylsuccinic anhydride, 9.95 grams (0.08 moles) THAM, 128.5 grams (0.94 moles) pentaerythritol and 1.43 grams of p-toluene sulfonic acid. The mixture was stirred and heated under nitrogen for three hours at 190° C. Nitrogen was passed through the mixture to remove water formed in the reaction. Then 37 grams (0.019 moles) of a polyoxypropylene amine (Jeffamine D 2000) and 630.5 grams (0.26 moles) of a polyisobutenyl succinimide of a tetraethylenepentamine mixture were added. This mixture was stirred for an additional 2.5 hours at 190° C. while sweeping with nitrogen to remove water. It was then diluted with 1017 grams of process oil and cooled to 130° C. Then 80 grams filter aid was added and the product was filtered, giving a useful ashless dispersant.

Other similar products can be made by substituting the other useful reactants described herein for those used in the above examples.

The additives are added to lubricating oil in an amount which provide the desired amount of dispersancy. A useful concentration is about 0.1-10 weight percent. A more preferred range is about 3–5 weight percent.

The present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount of the present additives sufficient to provide dispersancy.

The additives can be used in mineral oil or in synthetic oils of viscosity suitable for use in the crankcase of an internal combustion engine.

Mineral oils include those of suitable viscosity refined from crude oil from all sources including Gulfcoast, midcontinent, Pennsylvania, California, Alaska, mid-east, African, North Sea, Asian, and the like. Various standard refinery operations can be used in processing the mineral oil such as catalytic cracking, hydrocracking, hydrotreating and the like.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylolpropane, tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 10–25 weight percent hydrogenated α-decene trimer with 75–90 weight percent 150 SUS (100° F.) mineral oil results in an excellent lubricant. Likewise, blends of about 10–25 weight percent di-(ethylhexyl)adipate with mineral oil of proper viscosity results in a superior lubricating oil. Also blends of synthetic hydrocarbon oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkylaryl ZDDP are useful. A typical alkyl-type ZDDP contains a mixture of isobutyl and isoamyl groups. Zinc di-(nonylphenyl)-dithiophosphate is a typical aryl-type ZDDP. Good results are achieved using sufficient ZDDP to provide about 0.01–0.5 weight percent zinc. A preferred concentration supplies about 0.05–0.3 weight percent zinc.

Another additive used in the oil compositions is the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 weight percent alkaline earth metal and more preferably about 0.1–1.0 weight percent. In a most preferred embodiment the lubricating oil composition contains a calcium petroleum sulfonate or alkaryl (e.g. alkylbenzene) sulfonate.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

The present additives can be used in combination with other ashless dispersants such as the polyolefin-substituted succinamides and succinimides of polyethylene polyamides such as tetraethylenepentamine. The polyolefin succinic substituent is preferably a polyisobutene group having a molecular weight of from about 800 to 5000. Such ashless dispersants are more fully described in U.S. Pat. No. 3,172,892 and U.S. Pat. No. 3,219,666.

Another useful class of ashless dispersants are the polyolefin succinic esters of mono- and polyhydroxy alcohols containing 1 to about 40 carbon atoms.

The succinic amide, imide and or ester type ashless dispersants may be boronated by reaction with a boron compound such as boric acid. Likewise, the succinic amide, imide, and or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5000. The preferred polyethylene polyamine is tetraethylene pentamine. Such Mannich ashless dispersants are more fully described in the following U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,792,202; 3,798,165; 3,798,247 and 3,803,039.

The above Mannich dispersants can be reacted with boric acid to form boronated dispersants having improved corrosion properties.

Tests have been carried out which demonstrate the effectiveness of the present additives. The base oil in all cases was formulated to contain a phosphonate phenate, a zinc dialkyldithiophosphate, a low base and high base calcium sulfonate, an anti-foam agent and 4 weight percent of the test additive.

The additives were tested in the CAT 1H2 240-hour engine test. This is an industry standard diesel engine test. The results were as follows:

| Additive | TGC[1] | TWD[2] | Lacquer[3] Demerits |
|---|---|---|---|
| Commercial succinimide dispersant | 0, 17[4] | 282, 195[4] | 280, 133[4] |
| Example 7 | 27 | 69 | 10 |

[1]Top groove carbon
[2]Total weighted demerits
[3]Lacquer demerit is that portions of the TWD due to lacquer deposit.
[4]replicate runs These results clearly show the superiority of the present additives compared to a commercial succinimide ashless dispersant in reducing engine lacquer.

We claim:

1. An ashless dispersant for use in lubricating oil, characterised in that said dispersant is the product of reacting at a temperature of from about 100° to 350° C.

(a) about 0.9 to 1.1 moles of a hydrocarbon-substituted succinic acid or anhydride wherein said hydrocarbon substituent has an average molecular weight of at least about 700, (b) about 0.1 to 1.0 moles of an alcohol containing 1 to 6 hydroxy groups, (c) about 0.01 to 0.5 moles of a primary or secondary hydroxy-substituted amine containing 1 to 3 hydroxy groups, (d) about 0.01 to 2.5 moles of a hydrocarbyl succinimide or succinamide, and (e) about 0.005 to 0.5 moles of a polyoxyalkylene amine having the structure $$H_2N-R-(O-R)_m-NH_2 \text{ or } R_1[(O-R)_n-NH_2]_p$$

wherein R is a divalent aliphatic hydrocarbon group containing 2 to 4 carbon atoms, $R_1$ is a polyvalent saturated hydrocarbon radical having the valence p and containing 2 to 10 carbon atoms, m is an integer from 1 to 50, n is an integer from 1 to 40 such that the sum of all n's is from about 3 to 40 and p is an integer from 3 to 6, wherein said hydrocarbyl succinimide or succinamide in (d) is the product made by reacting a hydrocarbyl succinic anhydride, acid, or ester with an amine containing 2 to 6 amino nitrogen atoms, at least one of which is primary, and about 1 to 30 carbon atoms, at least part of said hydrocarbyl succinimide or succinamide containing at least one reactive primary or secondary amine group.

2. An ashless dispersant as claimed in claim 1 further characterized in that said alcohol is a hindered polyol containing 3 to 4 hydroxy groups.

3. An ashless dispersant as claimed in claim 2 further characterized in that the said hydrocarbon substituent of the hydrocarbon-substituted succinic acid or anhydride has a molecular weight from 700 to 5000.

4. An ashless dispersant as claimed in claim 2 further characterized in that said hydrocarbon substituted succinic acid or anhydride is a polyisobutylene-substituted succinic anhydride wherein said polyisobutylene substituent has an average molecular weight of about 700 to 2000 and said hindered polyol is selected from the group consisting of trimethylol ethane, trimethylol propane and pentaerythritol.

5. An ashless dispersant as claimed in claim 4 further characterized in that said primary or secondary hydroxy-substituted amine is selected from the group consisting of alkanol amines, dialkanol amines and tri-hydroxymethylaminomethane.

6. An ashless dispersant as claimed in claim 5 wherein said hydroxy substituted amine is selected from the group consisting of ethanol amine, diethanol amine and tri-hydroxymethylaminomethane.

7. An ashless dispersant as claimed in claim 6 further characterized in that said hydrocarbyl succinimide or succinamide is the product made by reacting polyisobutenyl succinic anhydride with a polyethyleneamine.

8. An ashless dispersant of claim 7 wherein said hindered polyol is pentaerythritol.

9. An ashless dispersant as claimed in claim 1 further characterized in that it is made by a process comprising reacting in a first stage:

(a) about 0.9 to 1.1 moles of a hydrocarbon-substituted succinic acid or anhydride wherein said hydrocarbon substituent has an average molecular weight of at least about 700, (b) about 0.1 to 1.0 moles of an alcohol containing 1 to 6 hydroxy groups, and (c) about 0.01 to 0.5 moles of a primary or secondary hydroxy substituted amine containing 1 to 3 hydroxy groups, to form an intermediate and in a second stage reacting said intermediate with:

(d) about 0.01 to 2.5 moles of a hydrocarbyl succinimide or succinamide, and (e) about 0.005 to 0.5 moles of a polyoxyalkylene amine having the structure $$H_2N-R-(O-R)_m-NH_2 \text{ or } R_1[(O-R)_n-NH_2]_p$$

wherein R is a divalent aliphatic hydrocarbon group containing 2 to 4 carbon atoms, $R_1$ is a polyvalent saturated hydrocarbon radical having the valence p and containing 2 to 10 carbon atoms, m is an integer from 1 to 50, n is an integer from 1 to 40, such that the sum of all n's is from 3 to 40 and p is an integer from 3 to 6, wherein said hydrocarbyl succinimide or succinamide in (d) is the product made by reacting a hydrocarbyl succinic anhydride, acid, or ester with an amine containing 2 to 6 amino nitrogen atoms, at least one of which is primary, and about 1 to 30 carbon atoms, at least part of said hydrocarbyl succinimide or succinamide containing at least one reactive primary or secondary amine group.

10. An ashless dispersant as claimed in claim 9 further characterized in that it is made by a process comprising reacting in a first stage (a) about 0.9 to 1.1 moles of a polyisobutylene-substituted succinic anhydride wherein said polyisobutylene substituent has an average molecular weight of about 700 to 2000, (b) about 0.7 to 1.0 moles of pentaerythritol, and (c) about 0.7 to 0.1 moles of tris-hydroxymethylaminomethane to form an intermediate and in a second stage reacting said intermediate with (d) about 0.01 to 0.5 moles of a polyisobutenyl succinimide, and (e) about 0.005 to about 0.15 moles of a polyoxyalkylene amine having the structure $$H_2N-R-(O-R)_m-NH_2 \text{ or } R_1[(O-R)_n-NH_2]_p$$

wherein R is a divalent aliphatic hydrocarbon group containing 2 to 4 carbon atoms, $R_1$ is a polyvalent saturated hydrocarbon radical having the valence p, containing 2 to 10 carbon atoms, m is an integer from 1 to 50, n is an integer from 1 to 40, such that the sum of all n's is from about 3 to 40 and p is an integer from 3 to 6, wherein said polyisobutenyl succinimide in (d) is the product made by reacting a polyisobutylene-substituted succinic anhydride wherein the average molecular weight of said polyisobutylene is about 700 to 2800 with a polyethylenepolyamine at least part of said polyisobutenyl succinimide containing at least one reactive primary amine group.

11. A lubricating oil composition comprising a major amount of an oil of lubricating viscosity and a minor amount sufficient to provide dispersancy of an ashless dispersant of claim 1.

12. A lubricating oil composition comprising a major amount of an oil of lubricating viscosity and a minor amount sufficient to provide dispersancy of an ashless dispersant of claim 10.

13. A method for preparing an ashless dispersant characterized in that the method comprises reacting at a temperature of from about 100° to 350° C.

(a) about 0.9 to 1.1 moles of a hydrocarbon-substituted succinic acid or anhydride wherein said hydrocarbon substituent has an average molecular weight of at least about 700, (b) about 0.1 to 1.0 moles of an alcohol containing 1 to 6 hydroxy groups, (c) about 0.1 to 0.5 moles of a primary or secondary hydroxy-substituted amine containing 1 to 3 hydroxy groups, (d) about 0.01 to 2.5 moles of a hydrocarbyl succinimide or succinamide, and (e) about 0.005 to 0.5 moles of a polyoxyalkylene amine having the structure $$H_2N-R-(O-R)_m-NH_2 \text{ or } R_1[(O-R)_n NH_2]_p$$

wherein R is a divalent aliphatic hydrocarbon group containing 2 to 4 carbon atoms, $R_1$ is a polyvalent saturated hydrocarbon radical having the valence p and containing 2 to 10 carbon atoms, m is an integer from 1 to 50, n is an integer from 1 to 40 such that the sum of all n's is from about 3 to 40 p is an integer from 3 to 6, wherein said hydrocarbyl succinimide or succinamide in (d) is the product made by reacting a hydrocarbyl succinic anhydride, acid, or ester with an amine containing 2 to 6 amino nitrogen atoms, at least one of which is primary, and about 1 to 30 carbon atoms, at least part of said hydrocarbyl succinimide or succinamide containing at least one reactive primary or secondary amine group.

* * * * *

UNITED STATES PATENT AND TRADEMARK OFFICE

CERTIFICATE OF CORRECTION

PATENT NO. : 4,401,581

DATED : AUGUST 30, 1983

INVENTOR(S) : AUBREY L. BURROWS and THOMAS J. WALTER

It is certified that error appears in the above-identified patent and that said Letters Patent is hereby corrected as shown below:

Column 4, line 35, reads "storage", and should read -- stage --.

Column 11, line 17, reads "0.1", and should read -- 0.01 --.

Column 12, line 11, reads "40 p", and should read -- 40 and p --.

Signed and Sealed this

*Fourth* Day of *September 1984*

[SEAL]

*Attest:*

GERALD J. MOSSINGHOFF

*Attesting Officer*

*Commissioner of Patents and Trademarks*